US006550661B2

(12) United States Patent
Aoki

(10) Patent No.: US 6,550,661 B2
(45) Date of Patent: Apr. 22, 2003

(54) BOOSTING MECHANISM FOR STAPLER

(75) Inventor: Akira Aoki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 09/900,981

(22) Filed: Jul. 10, 2001

(65) Prior Publication Data

US 2002/0005427 A1 Jan. 17, 2002

(30) Foreign Application Priority Data

Jul. 14, 2000 (JP) ..... 2000-215153

(51) Int. Cl.[7] ..... B25C 5/10
(52) U.S. Cl. ..... 227/134; 227/132
(58) Field of Search ..... 227/134, 132

(56) References Cited

U.S. PATENT DOCUMENTS 1,028,778 A * 6/1912 Powers et al. ..... 227/132
4,399,938 A * 8/1983 Biddle ..... 227/120
5,356,063 A * 10/1994 Perez ..... 227/132
5,699,949 A * 12/1997 Marks ..... 227/132
5,979,736 A * 11/1999 Edeholt ..... 227/132
6,179,193 B1 * 1/2001 Nagai ..... 227/123
6,209,772 B1 * 4/2001 Wang ..... 227/119

* cited by examiner

*Primary Examiner*—Rinaldi I. Rada
*Assistant Examiner*—Gloria R Weeks
(74) *Attorney, Agent, or Firm*—Morgan, Lewis & Bockius LLP

(57) ABSTRACT

Bearing pieces are formed on both sides of the rear end of a clincher arm which includes a clincher table for bending a staple at the front end thereof. A magazine member to which staples are loaded and a driver arm for driving out a staple fed from the magazine member are pivotally mounted on an axle, which is provided at the rear ends of the bearing pieces. A handle member is rotatably disposed above the driver arm. A rotation supporting shaft of the handle member is provided at a position somewhat closer to the front than the axle of the bearing pieces. A pin, which is provided at a position closer to the front than the rotation supporting shaft of the handle member, is inserted into an elongated hole formed in each side plate of the driver arm.

10 Claims, 7 Drawing Sheets

BOOSTING MECHANISM FOR STAPLER

BACKGROUND OF THE INVENTION

1. Field of the Invention

The present invention relates to a boosting mechanism for a stapler which enables one to drive out a staple by weak force.

2. Description of the Related Art

Where something is stapled with a staple of a stapler, if the size of the staple is large or the number of staples or sheets of paper to be stapled is increased, it is necessary to press down a handle member by strong force to drive the staple into the sheets. Accordingly, handling of the stapler by women or children is not easy.

To cope with this, a stapler with a boosting mechanism as shown in FIG. 7 is presented. In the boosting mechanism, a handle member 21 and a driver arm 22 for holding a driver are separately provided. The handle member 21 is pivotally mounted on a shaft 23 positioned somewhat rearward of a mid position of the driver arm 22. A shaft 25, which is provided to the driver arm 22 at further rearward of the shaft 23, is engaged with an elongated hole 26 formed in the handle member 21. When the handle member 21 is pressed down, strong force acts on the driver arm 22 according to the principles of the lever. Accordingly, the staple may be reliably driven with small driving-out force even if the staple is large in size or driven out into a thick sheet.

The principles of the lever is utilized in the stapler. For this reason, a point at which the shaft 25 of the clincher arm comes into engagement with the elongated hole 26 of the handle member serves as a point of action.

The inner edge of the elongated hole 26 receives a great force from the shaft 25. When the shaft 25, circular in cross section, engages with the inner edge of the elongated hole 26, the former linearly contacts with the latter. Accordingly, a force acting on the inner edge of the elongated hole 26 is considerably large. In this condition, the inner edge of the elongated hole 26 will be gradually deformed. When the elongated hole 26 is deformed, the boosting effect by the handle member will be reduced.

SUMMARY OF THE INVENTION

Accordingly, an object of the present invention is to provide a boosting mechanism for a stapler which is free from the deformation by the force acting on the point of action and improved in durability.

To achieve the above object, there is provided a boosting mechanism for a stapler. In the boosting mechanism, bearing pieces are formed on both sides of the rear end of a clincher arm which includes a clincher table for bending a staple at the front end thereof. A magazine member, to which staples are loaded, and a driver arm for driving out a staple fed from the magazine member are pivotally mounted on an axle, which is provided at the rear ends of the bearing pieces. A handle member is rotatably disposed above the driver arm. A rotation supporting shaft of the handle member is provided at a position somewhat closer to the front than the axle of the bearing pieces. A pin, which is provided at a position closer to the front than the rotation supporting shaft of the handle member, is inserted into an elongated hole formed in each side plate of the driver arm.

Preferably, the boosting mechanism is constructed as follows:

The rotation supporting shaft is formed by burring the bearing pieces of the clincher arm. Engaging grooves to be brought into engagement with the rotation supporting shaft are formed in the handle member. Further, when the driver arm is driven to move in a staple driving direction by pressing the handle member, the rotation supporting shaft is brought into engagement with a semicircular front end of each of the engaging grooves.

DETAILED DESCRIPTION OF THE PREFERRED EMBODIMENTS

Figure 1:
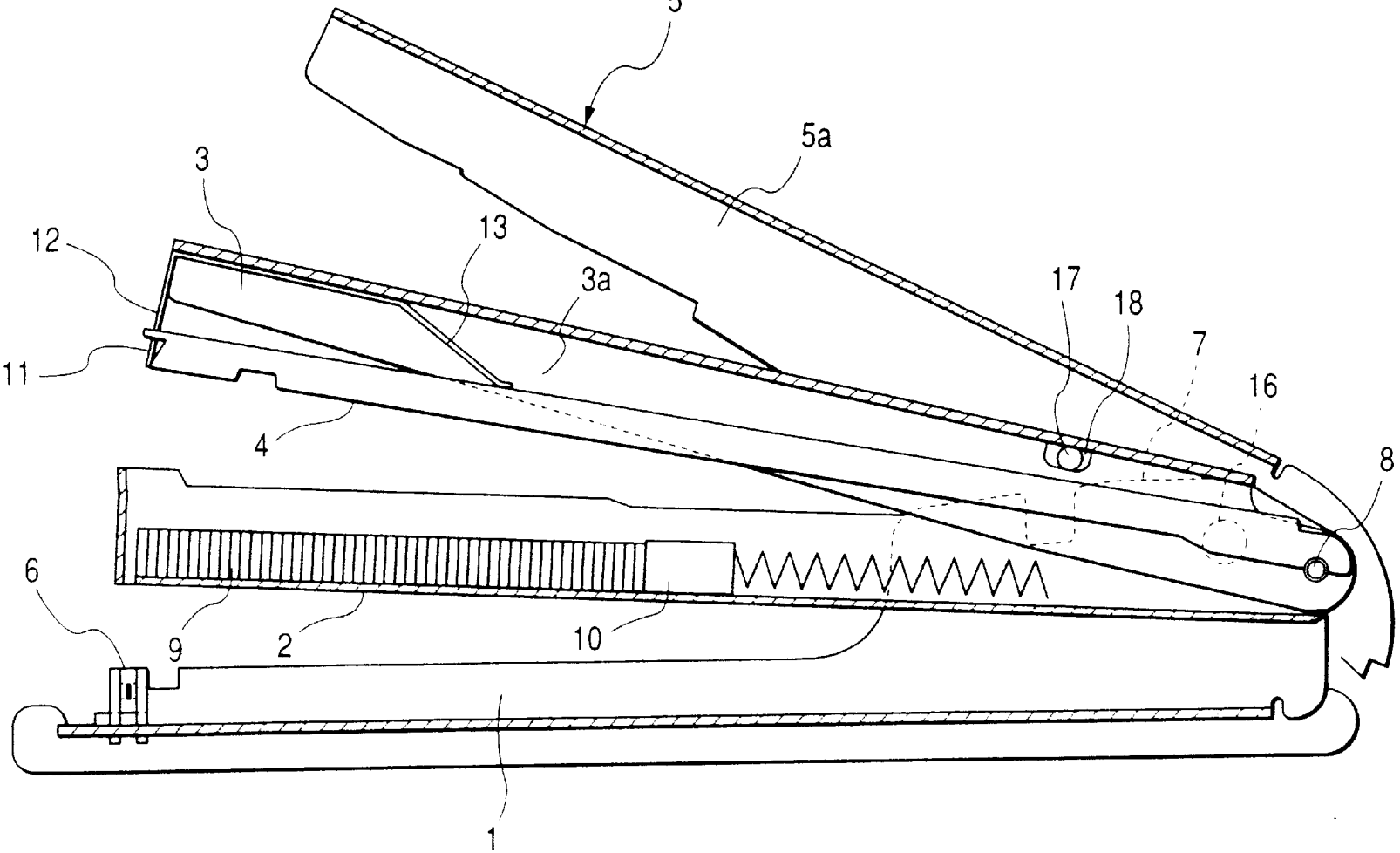
FIG. 1 is a side view showing a stapler with a boosting mechanism according to the present invention.
Figure 2:
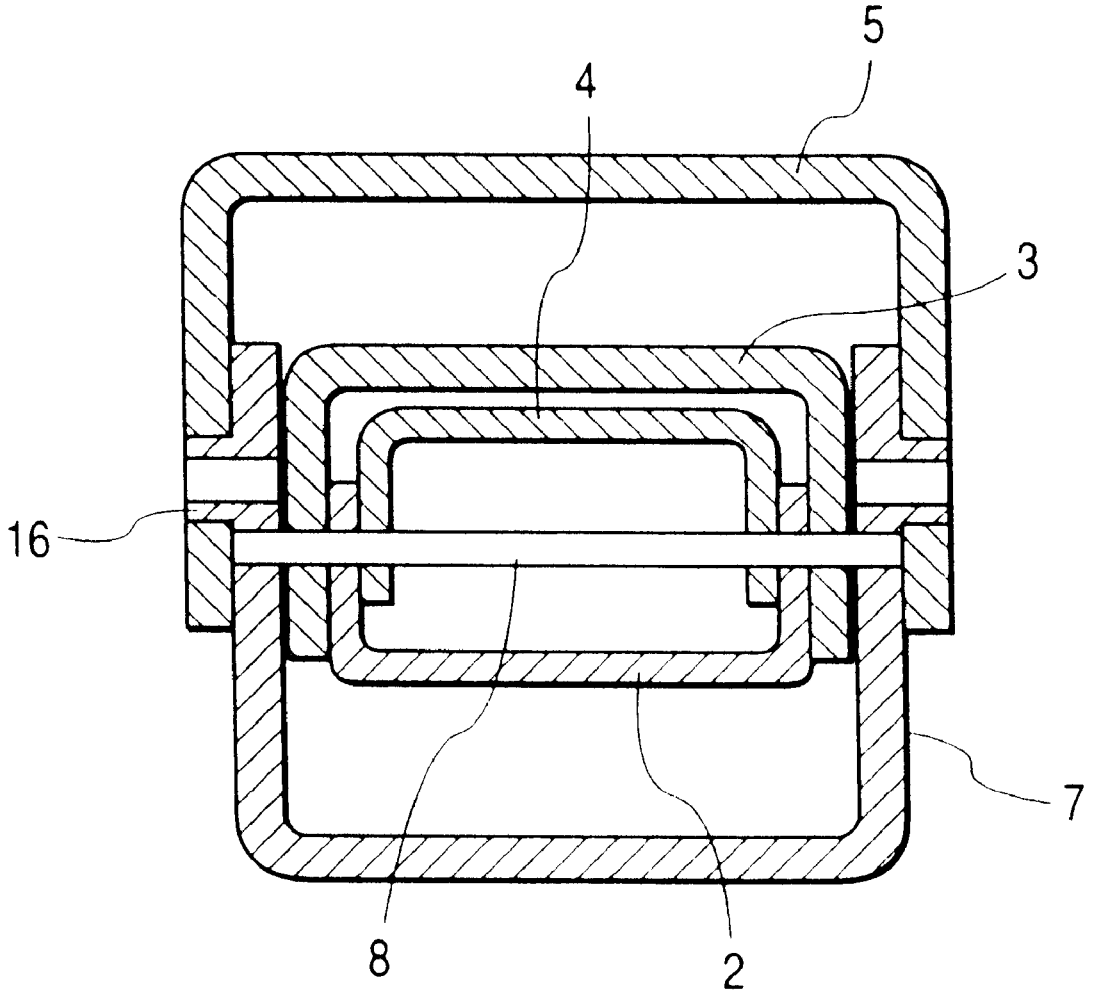
FIG. 2 is a cross sectional view showing a part including an axle in the stapler.

FIG. 1 is a side view showing a stapler, and FIG. 2 is a cross sectional view showing a part including an axle in the stapler. As in these figures, the stapler is composed of a clincher arm 1, a magazine member 2, a driver arm 3, a staple holder 4, and a handle member 5.

The clincher arm 1 includes a clincher table 6 for bending a staple, which is located at the front end thereof. When stapled, sheets to be stapled are located on the clincher table 6. Bearing pieces 7, while standing erect, are formed on both sides of the rear end of the clincher arm 1. An axle 8 is provided to the bearing pieces 7.

The magazine member 2 is shaped like U, with its cross section being opened upward. Inside the magazine member 2, a storing portion for connected staples is provided. Further, a pusher 10 is provided in the magazine member 2 and urges forward the connected staples loaded in the storing portion. The rear end of the magazine member 2 is pivotally mounted on the axle 8.

The driver arm 3 includes a driver 11 at the lower part of the front end thereof, and is pivotally coupled to the axle 8. The staple holder 4 is integrally provided on the inside of the lower part of the driver arm. The rear end of the staple holder 4 is engaged with the axle 8, and the fore end thereof passes through an opening 12 formed in the driver 11 and is engaged with the lower edge of the opening 12. The staple holder 4 is pressed downward by a spring member 13 provided on the lower surface of the driver arm 3. Thus, the staple holder 4 is turned always together with the driver arm 3.

The driver arm 3 must be high in strength and rigidity. Accordingly, it is thick and subjected to quenching treatment.

Figure 3:
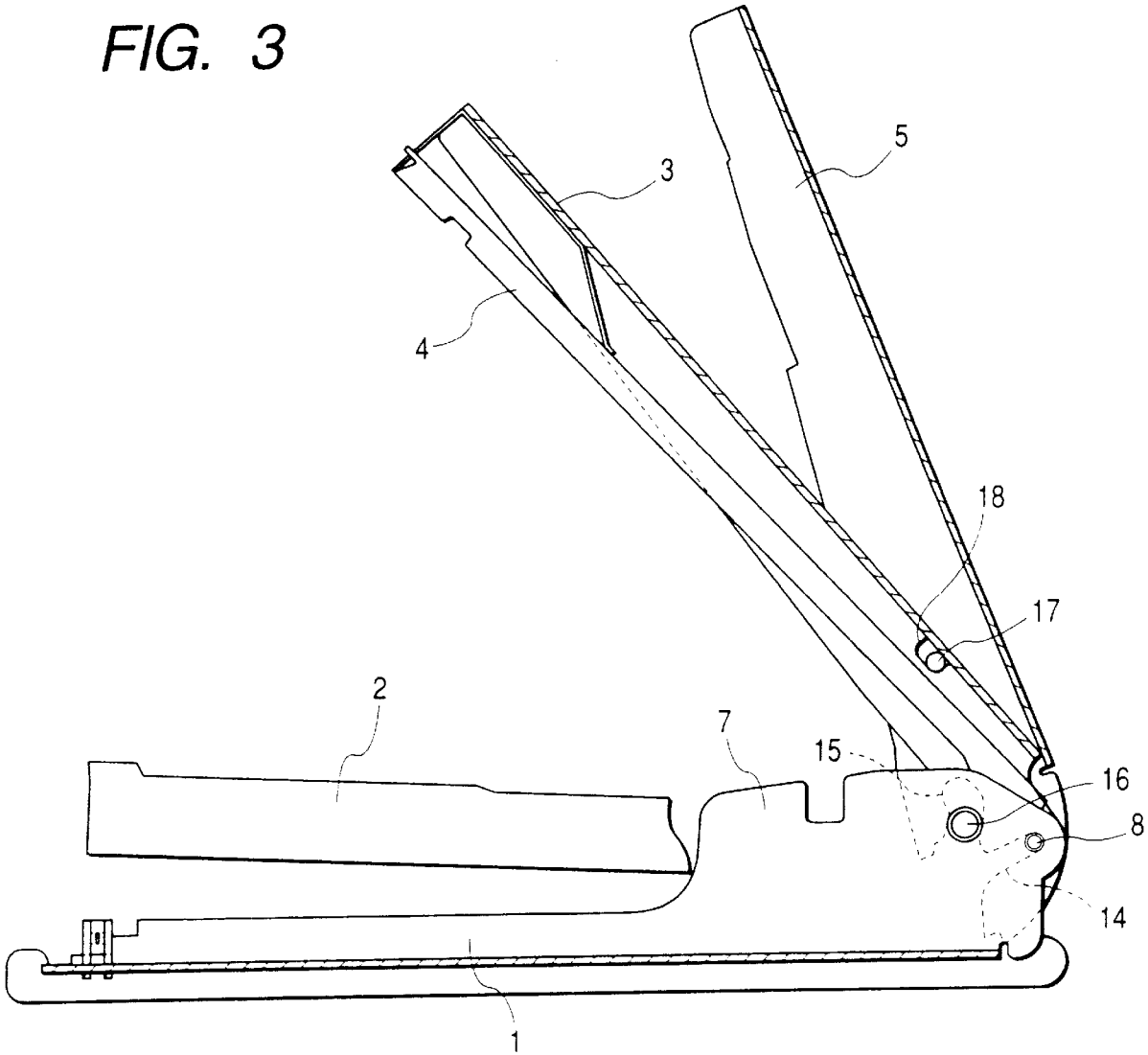
FIG. 3 is an explanatory view showing the state when a handle member of the stapler is turned upward.

The handle member 5 is rotatably disposed above the driver arm 3. The handle member 5 is also shaped like U, while its cross section is opened downward, and the driver arm 3 is to be placed within the handle member 5. As shown in FIG. 3, a guide groove 14 brought into engagement with the axle 8 and an engaging groove 15, shaped like V, are formed in the lower part of the rear end of each side plate 5*a* of the handle member 5. The front end of the engaging groove 15 is semicircular in shape with its diameter substantially equal to the diameter of the axle 8. An end portion of each guide groove 14 is opened.

The bearing pieces 7 of the clincher arm 1 is provided with a rotation supporting shaft 16, which serves as a fulcrum for the turning of the handle member 5. The rotation supporting shaft 16 is formed by burring each bearing piece 7. The rotation supporting shaft 16 engages with the engaging groove 15 of the handle member 5.

A pin 17 is provided at a position on the side plate of the handle member 5, which is closer to the front side than the rotation supporting shaft 16. An elongated hole 18 is formed in a side plate 3*a* of the driver arm 3 and receives the pin 17 inserted thereinto.

In the above structure, when the handle member 5 is pulled up in order to load the connected staples into the magazine member 2, the driver arm 3 is also turned about the rotation supporting shaft 16 since the pin 17 engages with the elongated hole 18 of the driver arm 3 as shown in FIG. 3. The handle member 5 is turned about the rotation supporting shaft 16. At this time, the guide groove 14 moves so as to pull the axle 8 to the inside. Accordingly, when an angle of the handle member 5 with respect to the clincher arm 1 increases, the rotation supporting shaft 16 disengages from the engaging groove 15.

Figure 4:
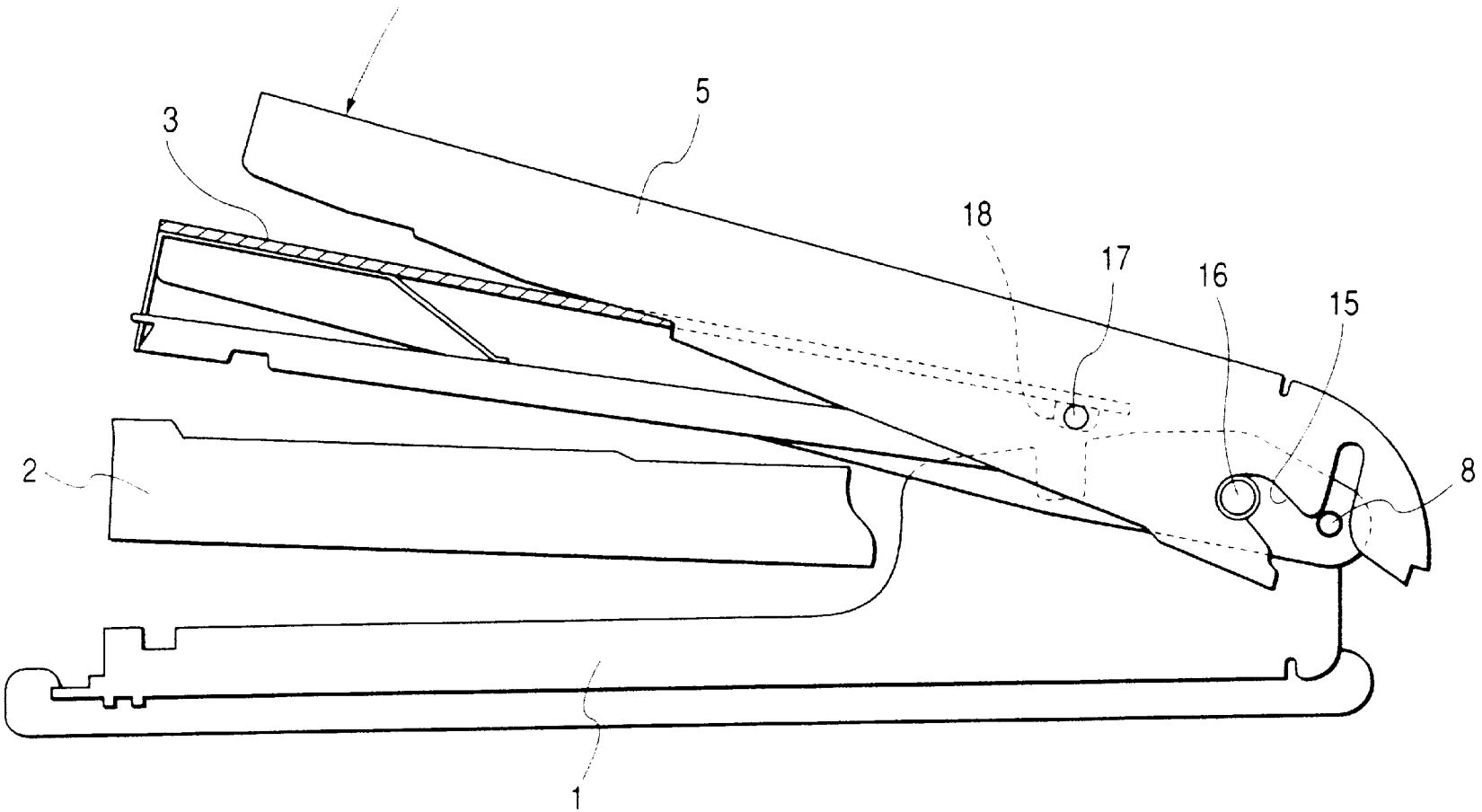
FIG. 4 is an explanatory view showing the state when the handle member of the stapler is turned downward.
Figure 5:
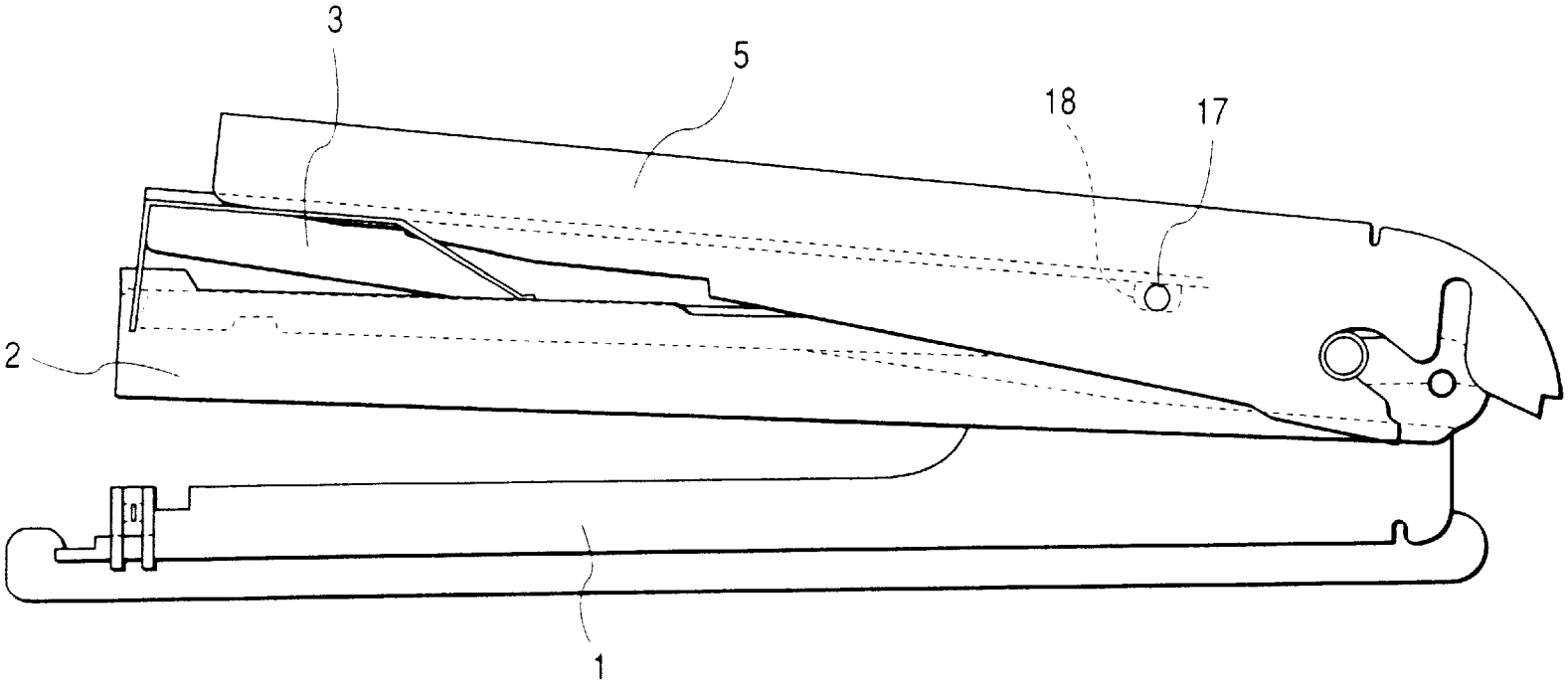
FIG. 5 is an explanatory view showing the state when a the handle member of the stapler is turned further downward and performing a stapling operation.

When the connected staples are loaded into the magazine member 2 and the staples are driven out, the handle member 5 is turned in a closing direction, as shown in FIG. 4. By this movement, the handle member 5 is turned in the direction reverse to the above-mentioned one. Thus, the front end of the engaging groove 15 comes in engagement with the rotation supporting shaft 16. When a further pressure is applied in the closing direction as shown in FIG. 5, the handle member 5 turns about the rotation supporting shaft 16. At the same time, since the pin 17 of the handle member 5 forcibly presses the lower edge of the elongated hole 18, the driver arm 3 also moves in the closing direction. At this time, the pin 17 serves as an action point. Therefore, even if the force pressing the front end of the handle member 5 is weak, the force pressing down the driver arm 3 is considerably large. As a result, the driver 11 is driven out by a strong force. Accordingly, a reliable stapling is ensured even if the force is weak.

In the operation of the stapler, the lower surface of the staple holder 4 holds an upper surface of the connected staples with allowing the connected staples within the magazine member 2 to pass therethrough before the driver arm 3 comes in contact with the staple at the front end of the magazine member 2. Thus, the coupled staples are guided without an unnecessary motion. In this state, the driver 11 drives out the staple at the front end of the connected staples.

As described above, when the staple is driven out, the pin 17 as a point of action of the lever forcibly presses the elongated hole 18 of the driver arm 3, so that a large load is applied to one point. However, the driver arm 3 is not deformed even if it receives such a load because the driver arm has undergone quenching treatment, and hence it has a high hardness. The driver arm 3 is quenched for the purpose of receiving the pin 17. The employment of the boosting mechanism inevitably requires that the driver arm 3 should be quenched. Accordingly, there is no possibility that the quenching brings about the specially increase of the cost to manufacture.

The rotation supporting shaft 16 serving as a fulcrum of the lever engages with the front end of the engaging groove 15 of the handle member 5. Since the inner circumferential surface of the engaging groove 15 is semicircular in shape, the half of the outer circumferential surface of the rotation supporting shaft 16 engages with the semicircular inner circumferential surface of the engaging groove 15. Therefore, the rotation supporting shaft 16 is in surface contact with the engaging groove 15. As a result, there is no case that the load concentrates at one point. Accordingly, the engaging groove 15 is neither deformed nor broken.

Figure 6:
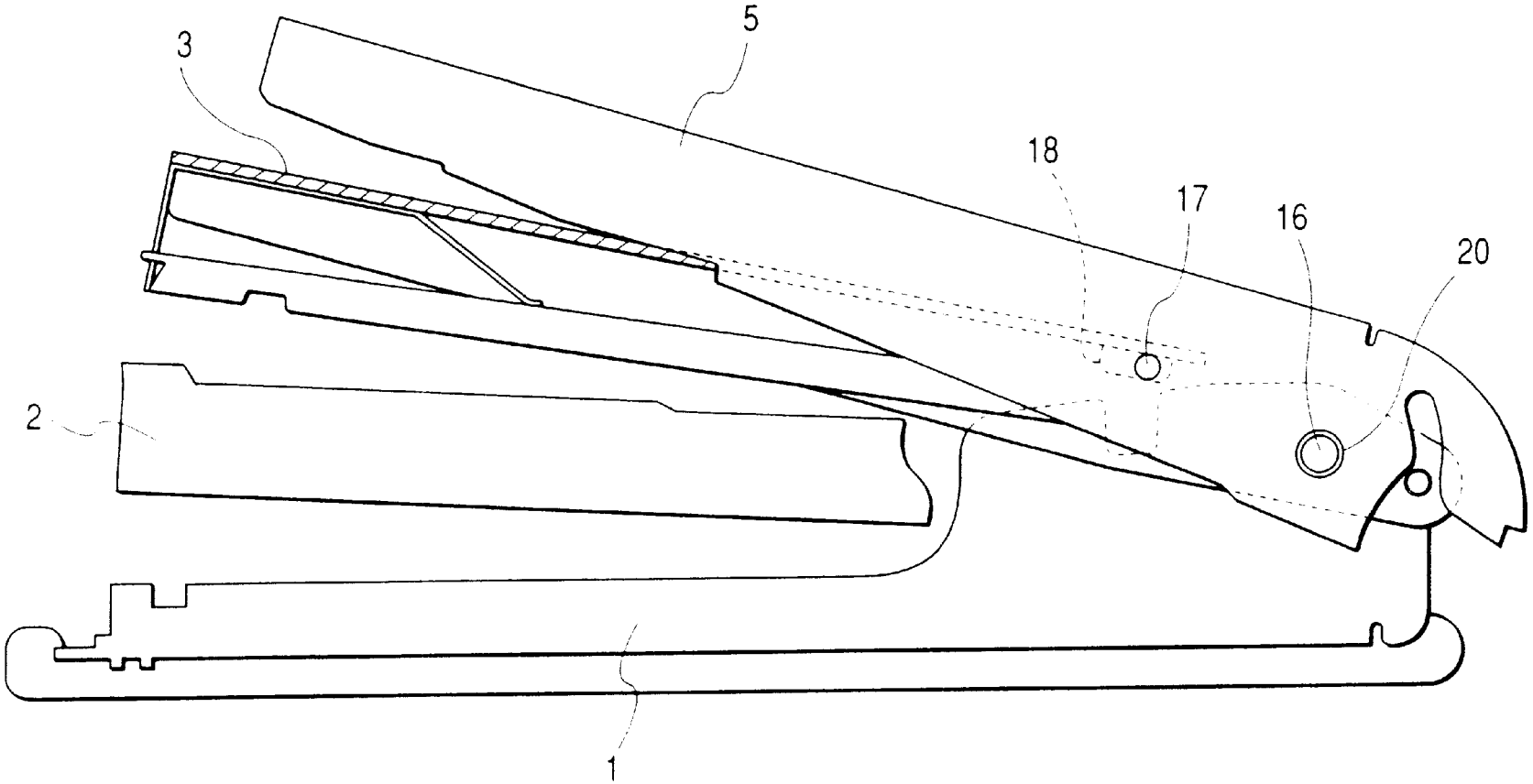
FIG. 6 is an explanatory view showing a structure according to another embodiment according to the invention.
Figure 7:
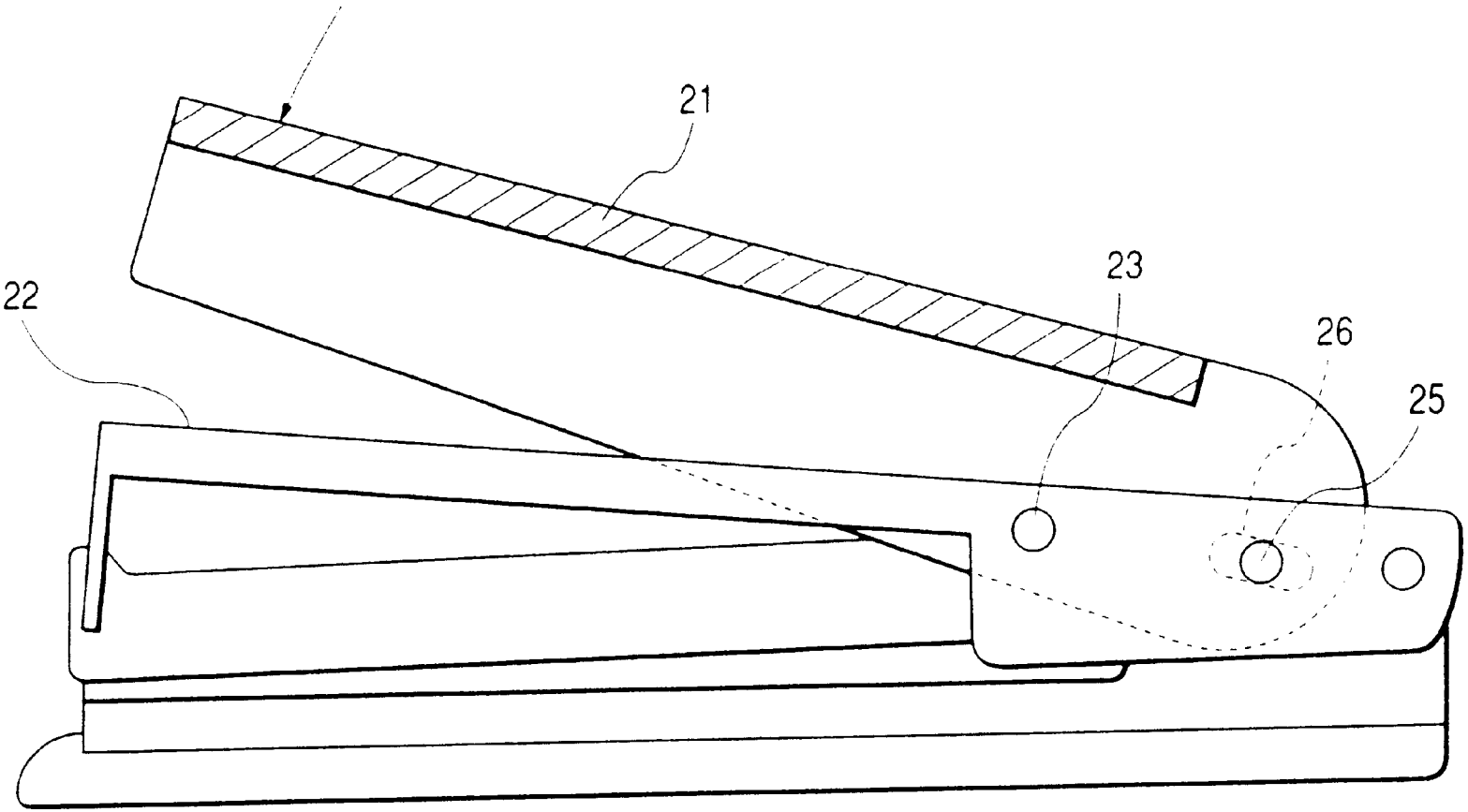
FIG. 7 PRIOR ART
FIG. 7 is an explanatory view showing a structure of a handle member according to a conventional stapler.

In a modification, as shown in FIG. 6, the rotation supporting shaft 16 is supported by the bearing receiving hole 20 of the handle member 5, whereby an elongated hole 18 of the driver arm 3 is further elongated.

While only certain embodiments of the invention have been specifically described herein, it will be apparent that numerous modifications may be made thereto without departing from the spirit and scope of the invention.

What is claimed is:

1. A boosting mechanism for a stapler, wherein:

bearing pieces are formed on both sides of a rear end portion of a clincher arm which includes a clincher table for bending a staple at a front end portion thereof;

a magazine member, to which staples are loaded, and a driver arm for driving out a staple fed from the magazine member are pivotally mounted on an axle, which is provided at rear end portions of the bearing pieces;

a handle member is rotatably disposed above the driver arm;

a rotation supporting shaft of the handle member is provided at a position closer to the front end portion than the axle of the bearing pieces; and a pin, which is provided at a position closer to the front end portion than the rotation supporting shaft of the handle member, is inserted into elongated holes formed in side plates of the driver arm.

2. The boosting mechanism for a stapler according to claim 1, wherein:

the rotation supporting shaft is formed by burring the bearing pieces of the clincher arm;

engaging grooves to be brought into engagement with the rotation supporting shaft are formed in the handle member; and the rotation supporting shaft is brought into engagement with a semicircular front end portion of each of the engaging grooves when the driver arm is driven to move in a staple driving direction by pressing the handle member.

3. A boosting mechanism for a stapler including a clincher arm having a clincher table for bending a staple at a front end portion thereof, a magazine member to which a plurality of the staples are loaded, a driver arm for driving out the staple fed from the magazine member, and a handle member rotatably disposed above the driver arm, said boosting mechanism comprising:

bearing pieces formed on both sides of a rear end portion of the clincher arm;

an axle provided at rear end portions of said bearing pieces wherein the magazine member and the driver arm are pivotally mounted on said axle;

a rotation supporting shaft provided to the handle member at a position closer to the front than said axle;

a pin provided at a position closer to the front end portion than said rotation supporting shaft; and elongated holes formed in side plates of the driver arm wherein said pin is inserted into said elongated holes.

4. The boosting mechanism for a stapler according to claim 3, wherein said rotation supporting shaft is formed by burring each of the bearing piece.

5. The boosting mechanism for a stapler according to claim 4, further comprising:

engaging grooves formed in the handle member, each including semicircular front end portions, wherein said rotation supporting shaft is brought into engagement with the semicircular front end portions of said engaging grooves when the driver arm is driven to move in a staple driving direction by pressing the handle member.

6. The boosting mechanism for a stapler according to claim 3, further comprising:

engaging grooves formed in the handle member, each including semicircular front end portions, wherein said rotation supporting shaft is brought into engagement with the semicircular front end portions of said engaging grooves when the driver arm is driven to move in a staple driving direction by pressing the handle member.

7. A stapler comprising:

a clincher arm including a clincher table for bending a staple at a front end portion thereof and bearing pieces formed on both sides of a rear end portion thereof;

a magazine member to which a plurality of the staples are loaded;

a driver arm for driving out the staple fed from the magazine member, said driver arm including elongated holes formed in side plates of said driver arm;

a handle member rotatably disposed above said driver arm;

an axle provided at rear end portions of the bearing pieces wherein said magazine member and said driver arm are pivotally mounted on said axle;

a rotation supporting shaft provided to said handle member at a position closer to the front end portion than said axle; and a pin provided at a position closer to the front than said rotation supporting shaft and inserted into the elongated holes of said driver arm.

8. The stapler according to claim 7, wherein said rotation supporting shaft is formed by burring each of the bearing piece.

9. The stapler according to claim 8, further comprising:

engaging grooves formed in said handle member, each including semicircular front end portions, wherein said rotation supporting shaft is brought into engagement with the semicircular front end portions of said engaging grooves when the driver arm is driven to move in a staple driving direction by pressing the handle member.

10. The stapler according to claim 7, further comprising:

engaging grooves formed in said handle member, each including semicircular front end portions, wherein said rotation supporting shaft is brought into engagement with the semicircular front end portions of said engaging grooves when the driver arm is driven to move in a staple driving direction by pressing the handle member.

* * * * *